US008123314B2

(12) United States Patent
Becke

(10) Patent No.: US 8,123,314 B2
(45) Date of Patent: Feb. 28, 2012

(54) REFRIGERATION DEVICE

(75) Inventor: Christoph Becke, Grosskarolinenfeld (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 235 days.

(21) Appl. No.: 12/519,395

(22) PCT Filed: Dec. 7, 2007

(86) PCT No.: PCT/EP2007/063497

§ 371 (c)(1),
(2), (4) Date: Jun. 16, 2009

(87) PCT Pub. No.: WO2008/077740

PCT Pub. Date: Jul. 3, 2008

(65) Prior Publication Data

US 2010/0031690 A1 Feb. 11, 2010

(30) Foreign Application Priority Data

Dec. 22, 2006 (DE) ..... 10 2006 061 152

(51) Int. Cl.
*A47B 96/04* (2006.01)
*E06B 1/00* (2006.01)
*A47B 9/00* (2006.01)

(52) U.S. Cl. ..... 312/405.1; 312/321.5; 108/107; 108/147.16

(58) Field of Classification Search ..... 312/405.1, 312/321.5, 351, 404; 108/106, 107, 110, 108/114.16, 147.16; 52/105; 434/73, 8
See application file for complete search history.

(56) References Cited

U.S. PATENT DOCUMENTS

| | | | | | |
|---|---|---|---|---|---|
| 597,186 | A | * | 1/1898 | Hunter | 108/110 |
| 984,857 | A | * | 2/1911 | Schuftan | 108/106 |
| 2,528,211 | A | * | 10/1950 | Civkin et al. | 434/80 |
| 2,741,370 | A | * | 4/1956 | Dills | 108/146 |
| 2,984,020 | A | * | 5/1961 | Levitas | 434/80 |
| 3,375,936 | A | * | 4/1968 | Kessler | 108/108 |
| 3,469,711 | A | * | 9/1969 | Swaneck et al. | 312/351 |
| 3,610,174 | A | * | 10/1971 | Kesling | 108/56.1 |
| 3,682,521 | A | * | 8/1972 | Kesling | 312/321.5 |
| 4,203,373 | A | * | 5/1980 | Conti | 108/152 |
| 4,626,218 | A | * | 12/1986 | Wright | 434/73 |
| 4,921,315 | A | * | 5/1990 | Metcalfe et al. | 312/321.5 |

(Continued)

FOREIGN PATENT DOCUMENTS

| | | | | |
|---|---|---|---|---|
| DE | 8517976 | U1 | | 10/1985 |
| DE | 9204742 | U1 | | 7/1992 |
| GB | 2176885 | A | * | 1/1987 |
| SU | 1003801 | | | 3/1983 |

*Primary Examiner* — David Dunn
*Assistant Examiner* — Ryan A Doyle
(74) *Attorney, Agent, or Firm* — James E. Howard; Andre Pallapies

(57) ABSTRACT

A refrigerator includes a door having a pair of lateral spaced supports on an inside of the door, and a height-adjustable door storage compartment removably securable via a snap-in structure to the inside of the door at locations between the pair of supports at a plurality of different heights, and a support having a vertically extending guide compatibly configured with a corresponding portion of the door storage compartment. The vertically extending guide and the corresponding portion of the door storage compartment engaging one another for orienting the door storage compartment relative to the door in an installed position of the door storage compartment on the door.

8 Claims, 1 Drawing Sheet

U.S. PATENT DOCUMENTS 5,729,934 A * 3/1998 Ochoa ..... 52/105
6,962,116 B2 * 11/2005 Bienick et al. ..... 108/108
7,178,890 B2 * 2/2007 Park et al. ..... 312/408
7,748,805 B2 * 7/2010 Lucas et al. ..... 312/405.1
2003/0011291 A1 1/2003 Moreno-Olguin et al.
2010/0176702 A1 * 7/2010 Kim ..... 312/405.1

* cited by examiner

Fig. 1
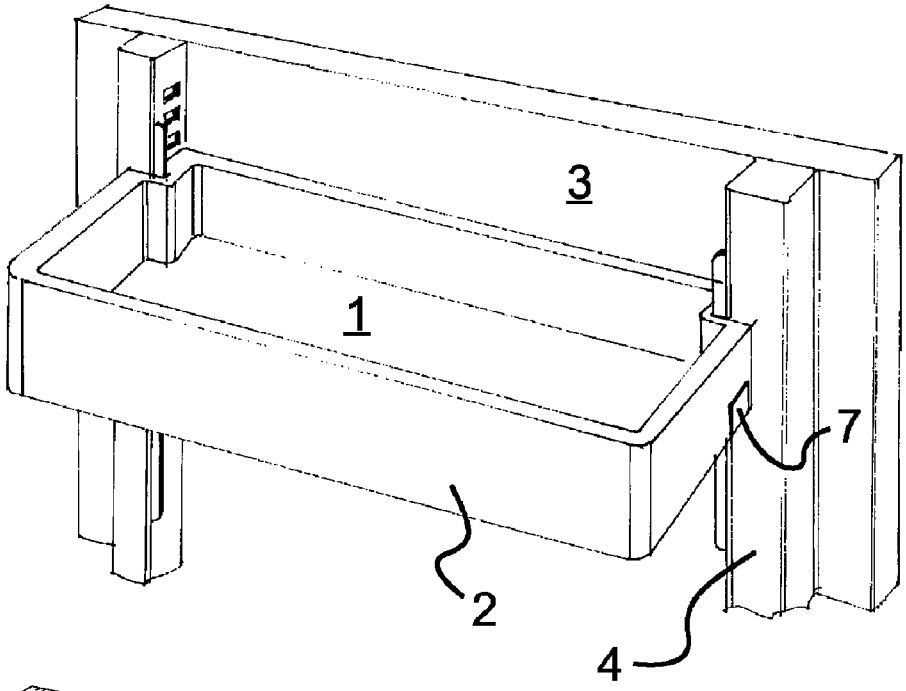
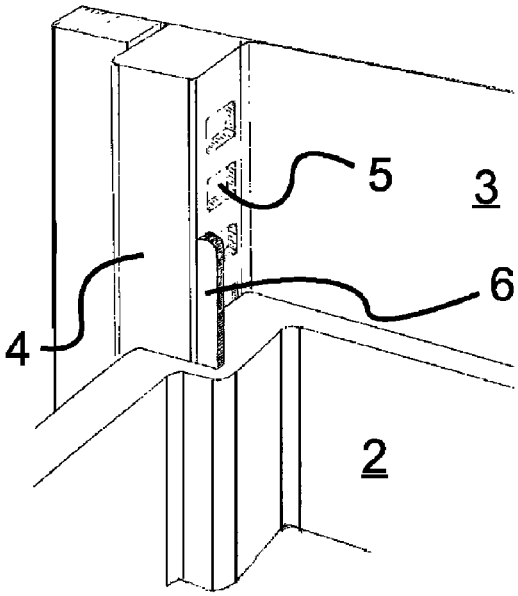
Fig. 2
Fig. 3
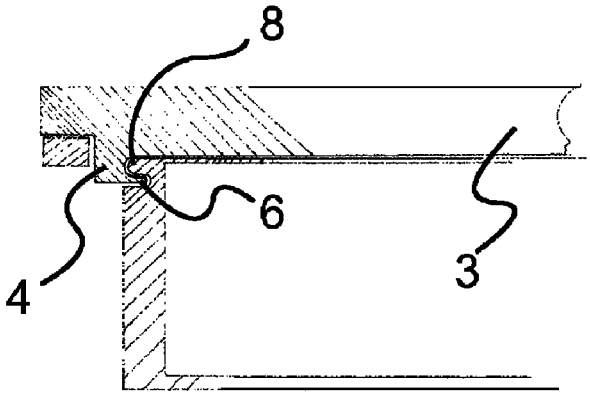

REFRIGERATION DEVICE

BACKGROUND OF THE INVENTION

The invention relates to a refrigeration device.

Refrigeration devices, especially refrigerators, usually feature door storage compartments, i.e. storage drawers or storage containers for refrigerated items such as bottles, eggs, butter containers or other smaller refrigerated items which are fastened detachably to the door. Often these door storage compartments or arranged adjustable in height on the door of the refrigeration device so that the spacing of the door storage compartments on the refrigeration device door can be adapted to different sizes of refrigerated items to be stored therein. Mostly different attachment positions for the door storage compartments are provided for this purpose on the door of the refrigeration device, so that usually two different adjustments are produced per door storage compartment, which provides a degree of flexibility in the arrangement of the door storage compartments.

However it is often desirable to provide a more precise positioning option for the door storage compartments adapted to different outer packaging sizes of the refrigerated items to be stored. DE 85 17 976 therefore discloses a very fine height adjustment option for door storage compartments. The levels for the height adjustment are provided by toothed-bar type rails arranged on the refrigerator door, into which snap-in lugs provided on the storage containers engage. To fix the storage container into the relevant snap-in level projections are provided on rails also attached to the refrigerator door to the side of the storage container into which claws attached to the storage container engage from the rear so that the snap-in lugs of the storage container are pressed firmly into the teeth of the toothed bars. The claws of the storage containers are able to be actuated by pushbuttons arranged on the sides of the storage containers. If the pushbuttons are actuated the claws release fully from the projection and release the container so that this can be taken out forwards and inserted into another level. Often however it is difficult to move these types of door storage compartments in the loaded state, since to do so they have to be taken out forwards, shifted and inserted again. During this operation refrigerated items which are generally arranged relatively loosely alongside each other in the door storage compartments can fall over or fall out. With door storage compartments in particular which extend over the entire width of the refrigeration device door and are often loaded relatively unevenly with refrigerated items, a height adjustment in the loaded state is therefore critical.

BRIEF SUMMARY OF THE INVENTION

The underlying object of the invention is to embody a refrigeration device with height-adjustable door storage compartments on the refrigeration device door such that a fine height adjustment of the door storage compartments is easily possible even in the loaded state.

An object is achieved in accordance with the invention by a refrigeration device.

According to the invention a snap-in option with a vertical guide for the door storage compartments is attached to the refrigeration device door. The guide consists of guide elements making a form fit into each other which are embodied for example as a groove and guide bar and runs along the support element of the refrigeration device door. The guide running to the side of the door storage compartment means that the compartment is suspended between the support elements and is protected from falling out or tipping forwards.

Depending on the depth of the support elements, sideways tipping of the released door storage compartments can already be prevented by these support elements themselves which enclose the door storage compartments to the side. The guide element prevents the released door storage compartment from tipping out forwards. This means that although the door storage compartment in the detached state can be moved vertically so that a height adjustment is made possible, at the same time it is secured in all other directions so that a height adjustment is also made possible in the loaded state without the risk of the refrigerated items falling over or falling out.

In a preferred embodiment the guide element extends only over a specific area along the refrigeration device door so that the guide is open at the top and possibly also at the bottom, so that the door storage compartment can be lifted away from the guide and removed completely. Preferably the area in which the guide element extends includes the area which is provided as height adjustment area for the guided door storage compartment. This allows the guide element which—depending on the design—can be easily visible along the support elements, to be used as visualization for the adjustment area. The adjustment path for the door storage container is indicated precisely by this.

In a further advantageous embodiment guide elements are provided on both support elements which enclose the door storage compartment on both sides. The strain for protecting the door storage compartment against tipping, especially forwards, is thus distributed equally onto both support elements, so that a markedly more stable guidance can be achieved even with relatively narrow and unobtrusive guide elements. This is especially advantageous since a guide element of narrow width is easier to clean than an element which projects out a long way into a component for guidance.

In a further advantageous embodiment the guide element is implemented on the support element as an undercut into which the door storage compartment can be suspended. The bar which forms the undercut serves especially advantageously here at the same time as a visualization for the adjustment range of the door storage compartment. It is also possible to provide the projecting element on the door storage compartment and have it engage in a groove on the support element. However a groove is less easily visible than a protruding bar and therefore gives a worse indication of the adjustment range. It is especially advantageous for the snap-in structure into which the snap-in projections of the door storage compartment can hook to be arranged on the support element precisely like the guide element. In this case both the snap-in structure and also the guide element can be mounted beforehand on the support element and arranged together with this on the refrigeration device door. This greatly simplifies the assembly of the entire door.

BRIEF DESCRIPTION OF THE DRAWINGS

Further details and advantages of the invention emerge from the subclaims in conjunction with the description of exemplary embodiment which are explained in detail with reference to the drawing.

The figures show:

FIG. 1 a perspective view of a door storage compartment on the inside of the door of an inventive refrigeration device, FIG. 2 a detailed view for attachment of the door storage compartment and FIG. 3 a section through a second exemplary embodiment.

DETAILED DESCRIPTION OF EXEMPLARY EMBODIMENTS OF THE PRESENT INVENTION

FIG. 1 shows the inner side of a refrigeration device door 3, with which two support elements 4 extending vertically running in parallel to each other are firmly connected. Furthermore a door storage compartment 1 with a frame 2 is provided. In each site section of the frame 2 a knob 7 is located close to the floor of the door storage compartment 1 which engages with a snap-in lug not visible in the figure. The snap-in lugs are located in the known manner in the rear area below the floor of the door storage compartment 1 and are pressed by a spring into a position in which they protrude sideways beyond the frame 2. The snap-in lugs together with the snap-in openings 5 of the support elements 4 form a snap-in structure.

In a preferred embodiment the support elements 4 possess a rectangular cross-section and feature snap-in openings 5 (FIG. 2). The snap-in openings 5 possess rectangular breakouts on the surface of the support element 4 which point in the direction of the other support element 4. The spacings of the snap-in openings 5 within a support element 4 are so small that a fine height adjustment of the door storage compartment is possible. The position and size of the snap-in openings 5 are identical for both support elements 4. The spacing of the support elements 4 from each other is dimensioned so that the side parts of the frame 2 slide between the support elements 4 without tipping. The snap-in lugs not shown here engage in the snap-in openings 5 of the support elements 4. In this way the door storage compartment 1 is fixed in its height.

Along the surface of the support element 4 which is provided with the snap-in openings 5 runs a guide element 6 in the form of a narrow bar which is firmly connected to the support element 4. The snap-in openings 5 are located between the guide element 6 and the refrigeration device door 3. The frame 2 is shaped so that it forms a groove which encloses the guide element 6 on the front and rear side. The guide elements 6 guarantee a secure guidance of the door storage compartment 1 and relieve the strain of tipping moments on the snap-in lugs in its fixed position.

The guide elements 6 can be embodied to run uninterrupted from top to bottom. The form-the fit guidance means however that when a number of door storage compartments 1 are used, certain problems can arise during handling. If for example a door storage compartment in the center is to be removed entirely in order to create more space between the remaining door storage compartments, all door storage compartments arranged above it must first be removed so that the door storage compartment to be taken out can be maneuvered out upwards. The guide elements 6 are therefore interrupted in an advantageous manner and are only provided over the adjustment range of each individual door storage compartment 1. Each door storage compartment 1 can thus be removed without the door storage compartments around it having to be moved.

The guide element 6 is easily visible and can thus be used for visualizing this adjustment area. When the door storage compartment 1 is in its snapped-in position the upper edge of the guide element 6 rests flush against the upper side of the frame 2 and the uncovered part of the guide element 6 protrudes downwards. If on the other hand the door storage compartment 1 is in the lower snap-in position, the lower edge of the guide element 6 rests flush against the floor of the door storage compartment 1 and the uncovered part of the guide element 6 protrudes upwards above the frame 2.

In a further exemplary embodiment—as is shown in FIG. 3—the support elements 4 as well as the guide elements 6 are part of the inner shell of the refrigerator door 3 and are produced in one piece with the latter. The constructive features described above remain unaffected by this. This constructive design can be implemented very cost effectively.

If a door storage compartment 1 is now to be suspended in the refrigerator door 3 the snap-in lugs snap into the guide elements 6 after the door storage compartment is inserted from above with a vertical movement while retaining the form fit connection between the door storage compartment 1 and the two guide elements 6 into snap-in openings 5. The snap-in lugs hold the door storage compartment 1 securely in this position.

To adjust the height of the door storage compartment the buttons 7 are pressed in against a spring force into the frame 2. This leads to be snap-in lugs being withdrawn at least to the point at which they form a flush fit with the frame 2 and release the door storage compartment 1. In this position of the snap-in lugs the door storage compartment 1 can be moved in a vertical direction along the guide elements 6. The form-fit connection between the door storage compartment 1 and the two guide elements 6 itself ensures during the adjustment that the door storage compartment 1 is smoothly guided and cannot tip forward even in the loaded state.

Releasing the buttons 7 leads to the snap-in lugs being pressed by the force of the spring back in the direction of the support elements 4 and resting against the latter. A further vertical movement of door storage compartment 1 leads to the snap-in lugs engaging in the next snap-in opening 5.

Since the door storage compartment can also be adjusted in height without any danger even in the loaded state, its position can also be adapted especially well to the refrigerated items stored within it. It is thus possible to subdivide the scarce storage space in the refrigerator doors 3 by varying at the position of the door storage compartments 1 loaded with refrigerated items.

The door storage compartments 1 can be easily removed for cleaning purposes. The inner side of the refrigerator door 3 is now also easy to clean since the guide elements 6, because of their shape and dimensions, do not adversely affect the ease of cleaning.

LIST OF REFERENCE SYMBOLS

1 Door storage compartment
2 Frame
3 Refrigerator door
4 Support element
5 Snap-in openings
6 Guide element
7 Button
8 Guide spring

The invention claimed is:

1. A refrigerator comprising:

a door having a pair of lateral spaced supports on an inside of the door; and a height-adjustable door storage compartment removably securable via a snap-in structure, which includes snap-in openings formed in the pair of lateral spaced supports, to the inside of the door at locations between the pair of supports at a plurality of different heights, and at least one of the supports support having a vertically extending guide compatibly configured with a corresponding portion of the door storage compartment, the vertically extending guide and the corresponding portion of the door storage compartment engaging one another for orienting the door storage compartment relative to the door in an installed position of the door storage compartment on the door and preventing the door storage compartment from tipping forward away from the inside of the door during movement of the door storage compartment along the vertically extending guide between the plurality of different heights, wherein the snap-in openings formed in the pair of lateral spaced supports are disposed between the vertically extending guide and the inside of the door having the pair of lateral spaced supports.

2. The refrigerator of claim 1, wherein the guide extends over a predefined section along a height of the refrigeration device door.

3. The refrigeration device of claim 1, wherein the guide delimits a range of adjustment for height adjustment of the door storage compartment.

4. The refrigerator of claim 1, further comprising another vertical guide and each of the vertical guides is located on a respective lateral side of the door storage compartment.

5. The refrigerator of claim 1, wherein the guide comprises a guide bar on the support.

6. The refrigerator of claim 1, wherein the snap-in structure is on the support.

7. The refrigerator of claim 1, wherein the supports comprise vertically arranged bars running along side edges of the door.

8. The refrigerator of claim 1, wherein the guide extends over the entire length of the supports.

* * * * *